United States Patent [19]

Holmes

[11] Patent Number: 4,602,449

[45] Date of Patent: Jul. 29, 1986

[54] COMBINATION SCREW-IN CHOKE HOLDER AND PLUG DEVICE

[76] Inventor: Jerry B. Holmes, 458 E. Main St., Huntingdon, Tenn. 38344

[21] Appl. No.: 779,666

[22] Filed: Sep. 24, 1985

[51] Int. Cl.[4] ..... F41C 27/00

[52] U.S. Cl. ..... 42/49.02

[58] Field of Search ..... 42/49 A, 49 R, 1 R, 42/1 W, 79, 90

[56] References Cited

U.S. PATENT DOCUMENTS

| | | | |
|---|---|---|---|
| 2,026,252 | 12/1935 | Russell et al. | 42/49 A |
| 2,620,581 | 12/1952 | Fiorini | 42/49 R |
| 2,635,378 | 4/1953 | Pinckney et al. | 42/49 A |
| 3,371,440 | 3/1968 | Cassell | 42/49 A |
| 3,777,383 | 12/1973 | Haines et al. | 42/49 A |
| 4,058,925 | 11/1977 | Linde et al. | 42/79 |

*Primary Examiner*—Charles T. Jordan
*Attorney, Agent, or Firm*—Pitts and Brittian

[57] ABSTRACT

A combination screw-in choke holder and plug device is provided. This device (30) serves to receive at least one screw-in type choke, such as a choke (32). In this regard, at least one end portion of the device (30) is internally threaded and includes an internal diameter and threads designed for threadably receiving the externally threaded portion of a conventional screw-in type choke. The effective length of the device and the outside diameter of the device are selected such that it will be received by the magazine of a conventional pump and/or semi-automatic shotgun. Thus, the device serves as a holder for screw-in type chokes and as a plug for the magazine of such shotguns.

8 Claims, 4 Drawing Figures

COMBINATION SCREW-IN CHOKE HOLDER AND PLUG DEVICE

TECHNICAL FIELD

This invention relates generally to magazine plugs for a conventional, semi-automatic and/or pump type shutgun. More particularly, the invention is directed to a combination screw-in choke holder and plug device which holds at least one shotgun choke. The device carrying a choke(s) has a preselected effective length such that it can be inserted into the magazine of a shotgun for carrying unused chokes.

BACKGROUND ART

Screw-in chokes or choke tubes are conventional accessories for shotguns. Normally, such chokes are externally threaded at one end portion such that they can be threadably received into the internally threaded end of the muzzle. These choking devices serve to control the pattern of the shot subsequent to discharge.

Shotgun owners will often substitute chokes on the muzzle of their shotguns in order to vary the shot pattern for desired results. The unused screw-in type choke is stored, as in the pocket of a hunting jacket, during periods of nonuse. These unused choked are readily susceptible to damage as by inadvertent contact with other metal objects or to being lost. Known patents which disclose features generally relating to the field of the present invention are U.S. Pat. Nos.: 2,620,581; 3,371,440; 3,777,383; and 4,058,925. While these patents disclose various devices which relate to the present invention, a combination choke holder and plug device incorporating the features of the present invention has heretofore not been known.

Accordingly, it is an object of the present invention to provide a device which serves as a holder for a screw-in type choke and which can also be used as a plug for the magazine of a conventional semi-automatic and/or pump type shotgun.

It is a further object of the present invention to provide such a device which can be inexpensively manufactured and readily installed into a shotgun magazine.

Yet another object of the present invention is to provide such a device in one embodiment which is hollow along its length, thereby reducing its effective weight and allowing the device to receive the shaft portion of a conventional plug therein.

Other objects and advantages of the present invention will become apparent upon reading the following detailed description together with the drawings.

SUMMARY OF THE INVENTION

A combination screw-in choke holder and plug device is provided. This device serves to receive at least one screw-in type choke. In this regard, at least one portion of the device is internally threaded and includes an internal diameter and threads designed for threadably receiving the externally threaded portion of a conventional screw-in type choke. The effective length of the device and the outside diameter of the device is selected such that it will be received by the magazine of a conventional pump and/or semi-automatic shotgun. Thus, the device serves as a holder for screw-in type chokes and as a plug for the magazine of such shotguns.

BEST MODE FOR CARRYING OUT THE INVENTION

Figures 1, 2:
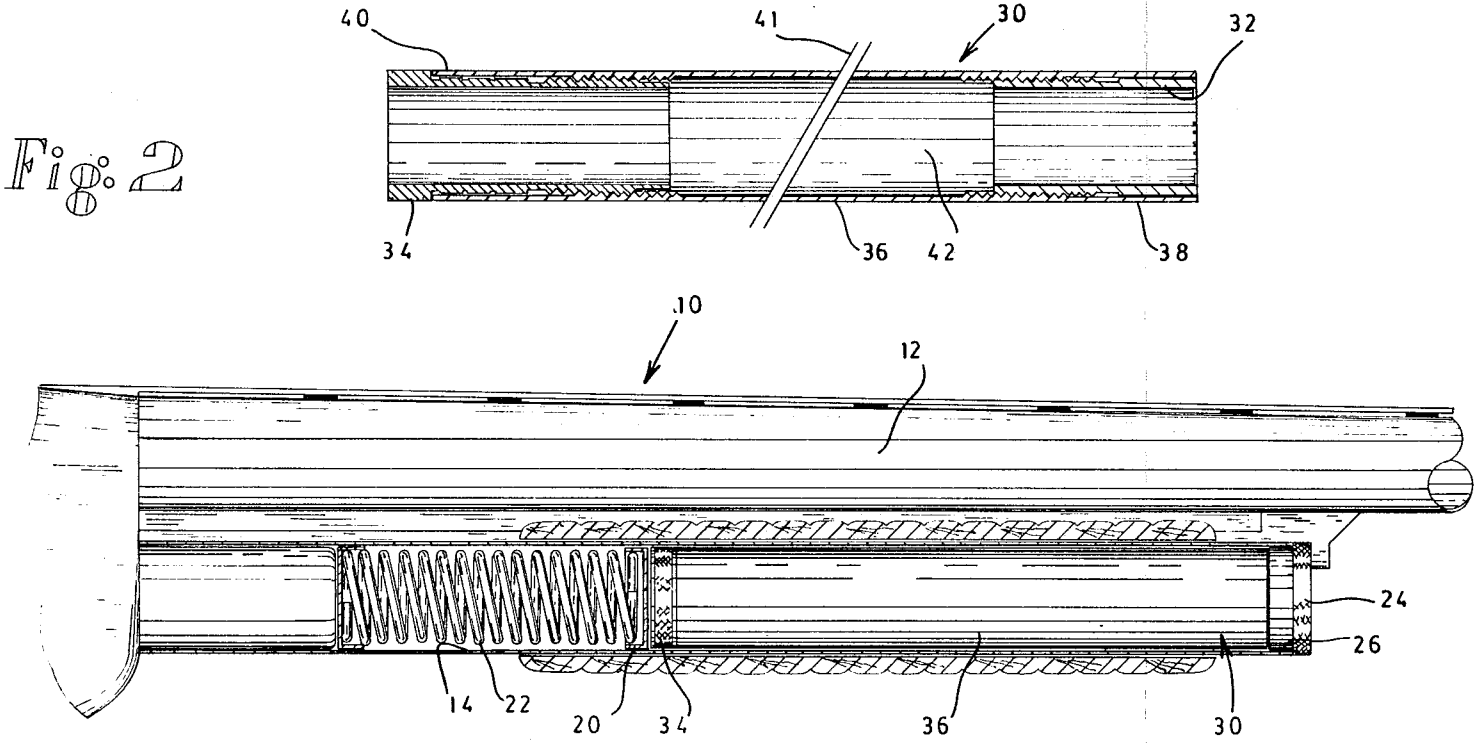
FIG. 1 is a break away view of the magazine portion of a conventional semi-automatic, and/or pump type shotgun with the device of the present invention inserted to replace a conventional plug.
FIG. 2 is a sectional view of a combination screw-in choke holder and plug device constructed in accordance with various features of the invention.

Referring now to FIG. 1, a partial sectional view of the barrel and magazine portions of shotgun 10 is illustrated. This shotgun is a conventional pump or semi-automatic shotgun commonly used by hunters. The barrel 12 of the shotgun terminates at its outward end portion in a muzzle (not shown). The muzzle portion of such a conventional shotgun is normally internally threaded for receiving a selected screw-in or tube type choke, which is chosen by the hunter to vary the shot pattern for a desired effect.

The magazine of the shotgun is illustrated at 14 in FIG. 1. This magazine normally carries a conventional plug such as a plug of the type 16 shown in FIG. 3 which serves to limit the number of shells which can be carried in the gun at any one time. For example, certain laws prohibit the insertion of more than two shells into the magazine of a shotgun, and this plug fills the space that could otherwise be occupied by shells.

The conventional plug 16 includes one flared end portion 18 and a shaft 19 which is inserted into the compression spring 22 in normal operation. The plug 16 controls the amount the compression spring can compress, and thus the length of the plug. A retainer ring 20 secures one end portion of the compression spring at a fixed location in the magazine in normal operation (not shown). The compression spring 22 and plug are held within the magazine by the magazine cap 24 threadably received by the end portion 26 of the magazine.

Figure 3:
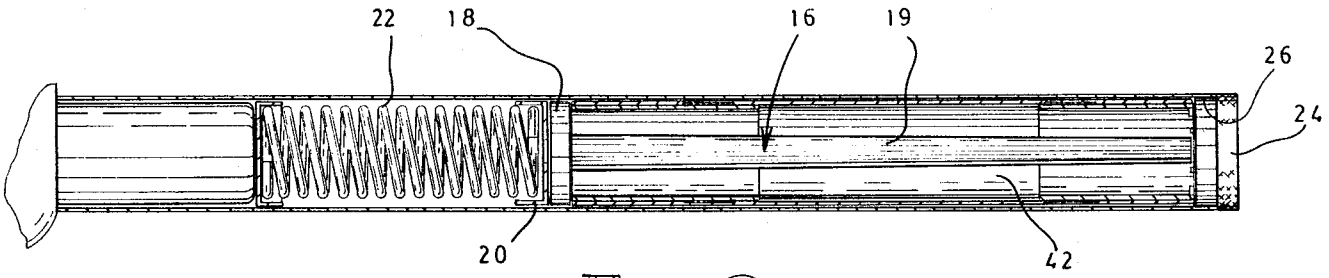
FIG. 3 depicts the device of the present invention mounted in the magazine of a shotgun with the barrel broken away and shows how the shaft of a conventional plug can be received in the device.

A combination screw-in choke holder and plug device which serves to replace and/or receive a conventional plug such as the plug 16 shown in FIG. 3 is generally indicated at 30 in FIG. 2. This device 30 serves to hold a screw-in type choke(s), such as the knurled choke 32 and the flush choke 34 depicted in FIG. 2. Further, the combination device 30 with a choke(s) mounted therein is designed to replace the plug 16 carried in the magazine 14 of a conventional semi-automatic and/or pump shotgun. To this end, the combination screw-in choke holder and plug device 30 includes a choke holder tube 36 illustrated in FIGS. 1 and 2. This choke holder tube has a preselected length which can be designed to fill a preselected portion of the magazine 14. The outside diameter of the choke holder tube is selected such that it can be slidably received within the magazine 14 upon removal of the magazine cap 24.

The choke holder tube 36 in the embodiment depicted in FIG. 2 includes a first end portion 38 and a further end portion 40. Each of these end portions include internally threaded sections having a preselected internal diameter which is proportioned for receiving the operatively associated externally threaded end portion of a screw-in type choke. More specifically, the internally threaded end portion 38 of the choke holder tube 36 receives the externally threaded section of the choke 32. Similarily, the externally threaded section of the screw-in type choke 34 is received within the internally threaded end portion 40 of the choke holder tube 36. It will be noted that the internal threads in the depicted embodiments of the choke holder tube 36 are offset from the terminal ends of the tube. The threads could, of course, extend to the tube ends.

It will be recognized that the combination device 30 formed by threadably joining the exemplary choke 34, the choke 32, and the choke holder tube 36 has an effective length. This effective length of the device 30 is designed such that it can be received within the magazine 14 of a shotgun. Further, this effective length will, of course, vary with the length of the choke holder tube 36 and the length of the chokes 32 and/or 34, or at least the portion of the chokes which extend beyond the terminal ends of the tube 36 when threadably mounted therein. Thus, the length of the choke holder tube 36 can be varied in fabrication to control the effective length of the device 30 carrying the screw-in type chokes. This ability to vary the effective length of the choke holder 36 during fabrication is illustrated by the break lines 41 in the drawing in FIG. 2, and by the break lines 41' in FIG. 3 which will be described in greater detail hereinafter.

In the combination screw-in choke holder and plug device illustrated in FIG. 2, the choke holder tube 36 includes a hollowed out internal portion 42. By hollowing out the choke holder tube 36 along its length, the effective weight of the device 30 can be reduced. In this connection, less weight will be added to the shotgun 10 when the device 30 is used as a plug for the magazine 14. Further, by hollowing out the internal portion 42 of the choke holder, the shaft 19 of a conventional plug can be received within the device tube 36 as shown in FIG. 3.

Figure 4:
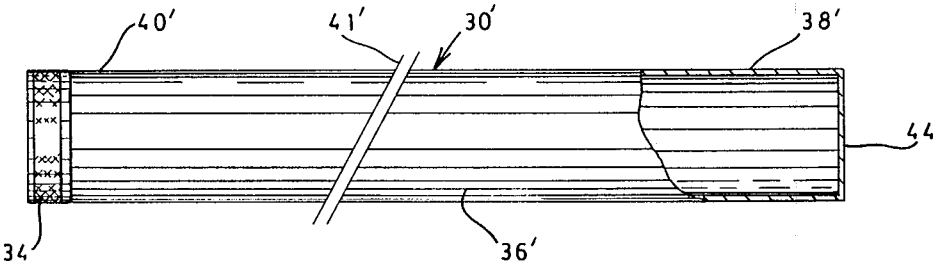
FIG. 4 illustrates a further embodiment of a device constructed in accordance with various features of the invention.

An alternate embodiment of the combination screw-in choke holder and plug device is illustrated at 30' in FIG. 4. This device 30' includes an internally threaded end portion 40' similar to the end portion 40 described in connection with the device illustrated in FIG. 2. This internally threaded end portion 40' carries a choke 34 of conventional design which serves to establish a preselected pattern in the discharged shot. It will be noted, however, that the opposite end portion 38' of the choke holder tube 36' is closed in the embodiment depicted in FIG. 4. Means generally indicated at 44 serve to close this end portion 38' of the choke holder tube 36'. Means 44 comprise a disc, cap, or the like, in the illustrated embodiment, which is secured to the terminating end portion of the choke holder tube 36' as by welding. The device 30' depicted in FIG. 4 serves to carry a single choke such that the effective length of this device is controlled by the length of the choke holder tube 36' and the choke 34, and, of course, their overlapping lengths resulting from threadably joining these members as is the case with respect to the device 30 shown in FIG. 2. Thus, the device 30' can be used by a shotgun owner who desires to carry a single, alternate choke in the magazine of the gun.

Of course, it will be recognized by those skilled in the art that the end portion 38' of the choke holder tube 36' can be left open, thereby eliminating the need of the closure means 44. However, this closure means 44 assists in preventing the collection of dust or other particles in the choke holder tube 36'.

The combination screw-in choke holder and plug device illustrated at 30 can be inserted in the magazine 14 of a shotgun by first removing the magazine cap 24, and then removing the magazine compression spring 22 and the conventional plug 16. The choke-laden holder tube 36 is then inserted into the magazine to push the retainer ring 20 until it is a selected depth in the magazine, which is the effective length of device 30. At this point, the end of the device 30 is substantially flush with the end portion of the magazine which threadably receives the cap 24. The combined device 30 is then left in the magazine and the cap of the magazine 24 is placed over the magazine. Of course, when a spring 22 is used, the effective length of the device 30 may be slightly less inasmuch as a portion of the length of the magazine 14 may be occupied by such spring. The device illustrated in FIG. 4 is inserted into the magazine in a similar manner with the exception that a single choke is carried by this device. Further, when it is desired to carry the conventional plug 19 in the device 30, the shaft of the plug 16 is inserted into the hollowed out portion 42 prior to putting the device in the magazine.

From the foregoing detailed description, it will be recognized by those skilled in the art that a combination screw-in choke holder and plug device has been provided which incorporates certain improved features. For example, the device can be fabricated with a preselected length such that it will plug a selected portion of a magazine of a shotgun when threadably joined with a single or with two screw-in choke type devices. This device facilitates storage of screw-in type chokes, and assists in preventing them from becoming damaged or lost. Thus, a user can carry alternate chokes within the magazine of the shotgun itself. These chokes can be readily accessed and substituted on the muzzle of a shotgun by simply removing the device 30 from the magazine and performing a simple substitution operation. The device can also be used as storage caddy or the container for gun cleaning supplies, etc., by simply capping the ends of the device after the cleaning supplies have been placed in the bottom section.

While the preferred embodiment of the present invention has been described and illustrated, it will be readily recognized by those skilled in the art that certain design changes can be made without departing from the spirit and scope of the invention. For example, the choke holder tube 36 can be fabricated from a number of materials, and can incorporate a feature allowing the variance of its effective length such as by telescoping two tubes together. Thus, the scope of the present invention is defined by the claims appended hereto and the equivalents thereof.

I claim:

1. A combination screw-in choke holder and plug device for holding at least one choke and plugging the magazine of a conventional semi-automatic and/or pump shotgun, said device comprising:

a choke holder tube having a preselected length and a preselected outside diameter;

said choke holder tube having a first end portion and a further end portion, at least one of said end portions including in an internally threaded section having a preselected internal diameter; and said internally threaded section serving to receive the externally threaded section of a screw-in type choke whereby the device formed by said choke holder tube threadably receiving said screw-in type choke can be inserted into a magazine of a shotgun, on which said choke can be mounted, to serve as a plug for said magazine.

2. The combination screw-in choke holder and plug device of claim 1 wherein said choke tube is generally cylindrical in configuration.

3. The combination screw-in choke holder and plug device of claim 1 wherein each end portion of said choke holder tube includes in an internally threaded section having a preselected internal diameter, each of said internally threaded sections serving to receive the externally threaded section of a screw-in type choke whereby the device formed by said choke holder tube threadably receiving a screw-in type choke at each of its end portions has a preselected effective length and serves as a plug upon insertion of said device into the magazine of a shotgun having a muzzle upon which said chokes can be mounted.

4. The combination screw-in choke holder and plug device of claim 1 wherein said choke holder tube is hollow along its length.

5. The combination screw-in choke holder and plug device of claim 2 wherein said choke holder tube is hollow along its length.

6. The combination screw-in choke holder and plug device of claim 3 wherein said choke holder tube is hollow along its length.

7. The combination screw-in choke holder and plug device of claim 4 wherein the end portion of said choke holder tube opposite said internally threaded section includes closure means for closing such end portion of said choke holder tube.

8. A combination screw-in choke holder and plug device for holding at least one choke and plugging the magazine of a conventional semi-automatic and/or pump shotgun, said device comprising:

a choke holder tube having a generally cylindrical configuration, a preselected length, and a preselected outside diameter for being received in the magazine of such conventional shotgun, said choke holder tube being hollow along its length and defining a first end portion and a further end portion, each of said end portions of said choke holder tube including an internally threaded section having a preselected internal diameter, said internally threaded section serving to receive the externally threaded section of a conventional screw-in type choke whereby the device formed by said choke holder tube threadably receiving said screw-in type chokes at each of its end portions, can be inserted into the magazine of a shotgun to serve as a plug for said magazine which has a preselected effective length defined by the combined lengths of said choke holder tube and said screw-in type chokes threadably received within such choke holder tube.

* * * * *